United States Patent [19]

Jackrel

[11] 4,430,759

[45] Feb. 14, 1984

[54] GLOVE

[76] Inventor: Donald Jackrel, 5 Maison Ct., Holbrook, N.Y. 11741

[21] Appl. No.: 418,574

[22] Filed: Sep. 15, 1982

[51] Int. Cl.[3] ..... A41D 19/00

[52] U.S. Cl. ..... 2/159; 2/164; 2/167

[58] Field of Search ..... 2/158, 159, 161 R, 164, 2/167

[56] References Cited

U.S. PATENT DOCUMENTS

| | | | |
|---|---|---|---|
| 211,614 | 1/1879 | Allerton | 2/164 X |
| 558,604 | 4/1896 | Engel | 2/164 |
| 2,004,382 | 6/1935 | Palicki | 2/164 |
| 2,072,541 | 3/1937 | Burnham | 2/164 |
| 2,285,538 | 6/1942 | Simon | 2/164 |
| 2,842,771 | 7/1958 | Foti | 2/164 X |
| 3,114,915 | 12/1963 | Gross | 2/158 |
| 3,173,150 | 3/1965 | Mohler | 2/167 |
| 3,866,245 | 2/1975 | Sutherland | 2/167 X |
| 3,869,726 | 3/1975 | Bell | 2/164 |
| 3,879,764 | 4/1975 | Weber-Liel | 2/167 |

*Primary Examiner*—Louis Rimrodt
*Attorney, Agent, or Firm*—James & Franklin

[57] ABSTRACT

A glove having three layers, an outer covering layer of leather, cloth or the like, an inner lining of an insulating material such as cloth, wool, fur and an intermediate member of a thin plastic having microscopically minute pores through which gas may pass but not liquids, e.g. water. The outer and inner layers are formed into gloves as by sewing. The intermediate layer of, for example, extremely thin polyurethane, is fabricated by heat sealing the edges of the front and back blank halves together to form an integral glove member. The intermediate glove layer is telescoped into the outer glove layer and similarly, the inner lining is telescoped into the intermediate layer. Only the outer and inner layers are stitched together at the wrist portion leaving a free-standing, breathable, waterproof intermediate layer therebetween which is integral and unattached. The resulting glove structure is water resistant and air permeable.

6 Claims, 4 Drawing Figures

GLOVE

BACKGROUND OF THE INVENTION

1. Field of the Invention

The present invention relates to improved gloves and other similar articles of wearing apparel which are waterproof or water resistant as well as air permeable. These garments prevent the passage of water while at the same time permitting body moisture to escape thereby reducing condensation and maintaining a comfortable dry environment about the wearer's body.

2. Description of the Prior Art

In the field of waterproof materials and garments, it has been the general practice to provide an outer water impermeable layer joined to an inner insulating layer. Such garments have been unsatisfactory in that body moisture is not permitted to escape and condenses within the garment leaving the inner surfaces proximate the wearer moist and in most cases wet. In order to overcome the foregoing deficiencies a breathable water resistant layer has been substituted for the waterproof material and generally bonded and/or stitched to another layer. Likewise, the addition of a breathable layer has proved unsatisfactory in that, since the layer must be extremely thin any small puncture or bonding of the surface will result in loss of water resistance. Bonding or stitching of the breathable layer substantially reduces its ability to function effectively.

SUMMARY OF THE INVENTION

The general purpose of this invention is to provide a breathable, waterproof glove and a material suitable for a garment that has all the advantages of similarly employed materials but has none of the above described disadvantages. To attain this, the present invention as it relates to a glove, provides a unique glove/garment construction in which a breathable, waterproof layer of thin polyurethane or expanded polytetrafluorethylene or any thin plastic which contains microscopically small pore openings therethrough is free-standingly sandwiched between an outer protective layer and an inner finger engaging layer. The sandwiched layer is entirely free of either of the other layers.

An object of the present invention is to provide a breathable, waterproof glove which is easily fabricated and is suitable for use in varying environments while retaining the necessary flexibility.

Another object is to provide an improvement in clothing materials particularly hand coverings which is characterized by its resistance to liquid penetration while providing ease of passage for moisture therethrough.

Still another object is the provision of improvements in the fabrication of gloves which includes the method and combination of materials described above.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
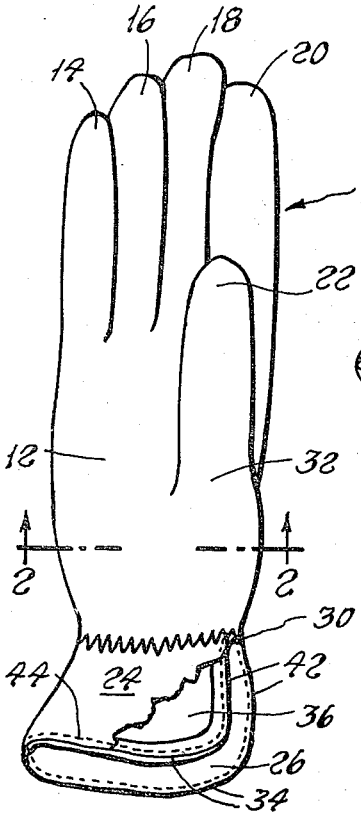
FIG. 1 shows a glove fabricated in accordance with the principle of this invention.

As shown in FIG. 1 the illustrated embodiment of the hand covering made in accordance with the present invention is a glove but could equally well be a mitten or the like. The glove 10 includes a palm portion 12, finger stalls 14, 16, 18, and 20, a thumb stall 22, and a gauntlet 24 having an opening 26 facing inwardly of the wearer. The glove is further provided with a peripherally extending elastically yielding area 30 proximate the wrist portion. An elastic tape is secured by stitching to the palm porion inside of the outer glove covering layer 32 while this area is in a gathered condition to thereby provide close contact of the glove to the wearer's wrist.

Figure 2:
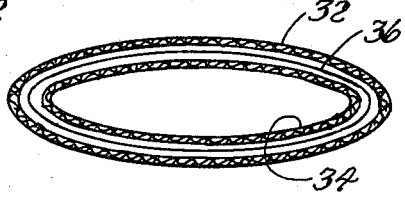
FIG. 2 is a cross-sectional view taken along line 2—2 of FIG. 1.

FIG. 2 shows the relationship of the three layers comprising the entire glove. The outer covering layer 32 is of a protective, flexible material such as leather, cloth or the like. The various components constituting the outer covering layer are cut and stitched together as is well known in the trade to form a hand covering glove. Similarly, an inner lining 34 of an insulating material as for example, wool, cloth, fur and the like is cut and formed into a hand covering structure. The overall size of the inner lining glove is of a slightly smaller size than the outer covering so that it can be readily telescoped therein. Thus these two layers are characterized by providing warmth, protection and flexibility while conforming to the wearer's hand. Although the outer covering layer 32 of the glove is and can be made somewhat water resistant, it is not waterproof; in a dry state it is air permeable, namely, it breathes. However under most conditions, when exposed to any concentration of water, the water will penetrate through the layers to the wearer's hand. In order to provide a barrier to the passage of liquid through the glove there is provided an intermediate waterproof, breathable layer 36 between the outer covering 32 and the inner lining 34. Waterproof layers are well known and include various rubbers and plastics. The majority of such materials although waterproof are also air impermeable. Use of such materials confines the moisture generated by the wearer within the glove and with the continued build-up of moisture it eventually condenses leaving the surfaces proximate the wearer moist and wet. Under these conditions the insulating properties of the glove are substantially diminished. Therefore, in order to overcome this problem the intermediate layer must permit the passage of moisture away from the wearer's hand or body.

Thin expanded plastic membranes exhibit the properties of being both waterproof and air permeable. These materials generally are less than 2 mm. in thickness and include microscopically minute pores which are small enough to permit the passage of gases but not liquids such as water. Two well known examples of such plastics are expanded polyurethane films and polytetrafluorethylene. The inventor has discovered, however, that when used in the construction of garments these plastic films lose their waterproof qualities when subjected to adherence to another layer as by bonding or cementing or by being subjected to penetration due to stitching. It has been found that no matter how restrictive the stitching, there is passage of water through the membrane. In overcoming this inherent deficiency there is provided an integral glove of a plastic layer as set forth above.

Figure 3:
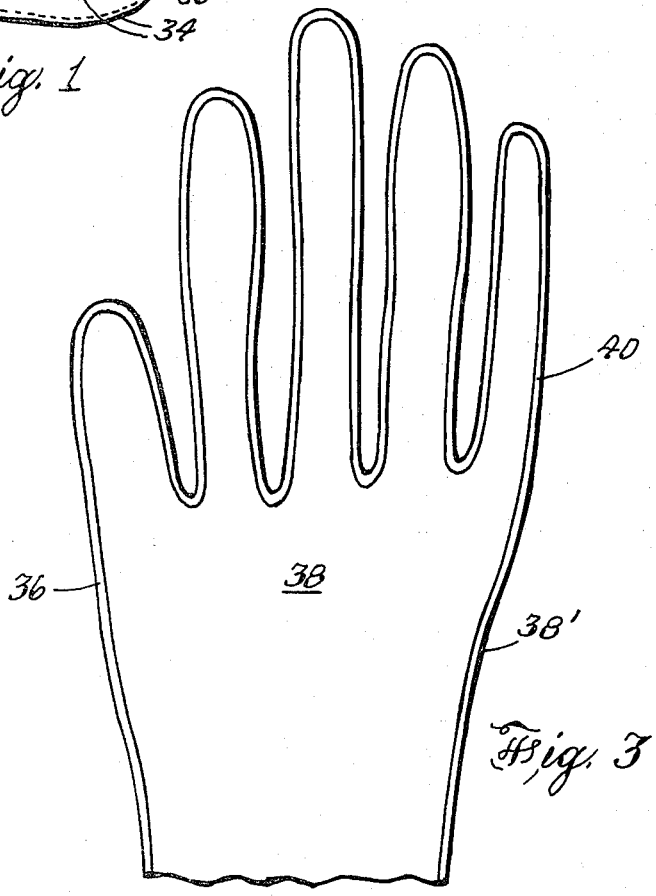
FIG. 3 is an illustration showing the intermediate breathable glove layer.

Fabrication of the intermediate plastic glove layer, as shown in FIG. 3, commences with the formation of a pair of generally identical blanks 38,38' of a size to readily fit between the outer covering and the inner lining. Care must be exercised so as not to pinch, exert excessive stretch or puncture the plastic membrane. The blanks 38 and 38' are laid one over the other and are joined along their peripheral edges 40 by heat sealing or any other suitable means to maintain water tight integrity.

Figure 4:
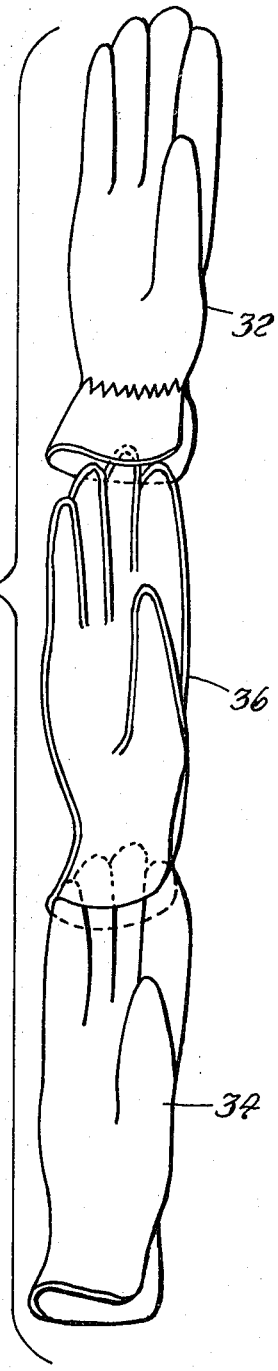
FIG. 4 illustrates the telescoping assembly of the various layers comprising the glove of this invention.

Assembly of the finished glove is accomplished, as shown in FIG. 4, by first telescoping the intermediate waterproof, breathable glove layer 36 into the covering glove layer 32. Next, the inner lining glove layer 34 is telescoped into the intermediate glove layer 36. Finally, with the glove layers one inside the other, the lining layer is joined to the covering layer only along the peripheral edge 42 defining the open gauntlet portion 24 as by stitching 44 (see FIG. 1) or any suitable means. It should be noted that the intermediate layer 36 is not joined to either of the other layers and that it is free of the stitched area 44 so that it has not been punctured or bonded. The intermediate glove layer is therefore entirely free-standing with respect to the other two layers. In fabricating any type of garment, whether a glove or otherwise, the waterproof, breathable layer must be and remain entirely free-standing.

Clearly, the foregoing inventive concept can be applied to any wearing apparel such as clothes, shoes, hats and similar articles by merely employing three plies with the intermediate ply being of the plastics described above and assuring that it is entirely free-standing between the other plies.

It should be understood, of course, that the foregoing disclosure relates only to the preferred embodiment of the invention and that numerous modifications or alterations may be made therein without departing from the spirit and the scope of the invention as set forth in the appended claims.

I claim:

1. A hand covering apparel comprising in combination a flexible, protective outer covering layer, an inner lining layer disposed in telescoped relation to the outer covering layer to receive the wearer's hand, an intermediate layer of thin, flexible plastic sheet material interposed between said lining and said outer covering, said interposed layer being both waterproof and air permeable and being entirely free of any attachment to said other layers whereby said hand covering is waterproof and can breath freely.

2. The hand covering according to claim 1 wherein said plastic sheet material is polyurethane and includes microscopically minute openings therethrough.

3. The hand covering according to claim 1 wherein said plastic sheet material is expanded polytetrafluorethylene and includes microscopically minute openings therethrough.

4. A hand covering apparel comprising an outer flexible protective glove, an intermediate glove telescoped within said outer glove, and an inner lining glove telescoped within said intermediate glove, said intermediate glove being of a liquid impervious and air permeable, thin, flexible plastic, said intermediate glove being free of any attachment to said other gloves and said other gloves being joined together only along their peripheral wrist edge portions.

5. The hand covering according to claim 4 wherein said plastic sheet material is polyurethane and includes microscopically minute openings therethrough.

6. The hand covering according to claim 4 wherein said plastic sheet material is expanded polytetrafluorethylene and includes microscopically minute openings therethrough.

* * * * *